US007204084B2

(12) United States Patent
Ma et al.

(10) Patent No.: US 7,204,084 B2
(45) Date of Patent: Apr. 17, 2007

(54) HYDRAULIC SYSTEM HAVING A PRESSURE COMPENSATOR

(75) Inventors: Pengfei Ma, Naperville, IL (US); Jiao Zhang, Naperville, IL (US)

(73) Assignees: Caterpillar Inc, Peoria, IL (US); Shin Caterpillar Mitsubishi Ltd. (JP)

( * ) Notice: Subject to any disclaimer, the term of this patent is extended or adjusted under 35 U.S.C. 154(b) by 2 days.

(21) Appl. No.: 10/975,413

(22) Filed: Oct. 29, 2004

(65) Prior Publication Data

US 2006/0090460 A1 May 4, 2006

(51) Int. Cl.
*F15B 13/04* (2006.01)
*F15B 13/08* (2006.01)

(52) U.S. Cl. ..... 60/422; 60/459; 91/446

(58) Field of Classification Search ..... 60/422, 60/459; 91/446, 447, 464
See application file for complete search history.

(56) References Cited

U.S. PATENT DOCUMENTS 3,366,202 A 1/1968 James
4,046,270 A 9/1977 Baron et al.
4,222,409 A 9/1980 Budzich
4,250,794 A 2/1981 Haak et al.
4,316,486 A 2/1982 Tandrup et al.
4,416,187 A 11/1983 Nystrom
4,437,385 A 3/1984 Kramer et al.
4,480,527 A 11/1984 Lonnemo
4,581,893 A 4/1986 Lindbom
4,586,330 A 5/1986 Watanabe et al.
4,623,118 A 11/1986 Kumar
4,662,601 A 5/1987 Andersson
4,706,932 A 11/1987 Yoshida et al.
4,711,267 A 12/1987 Schwelm
4,747,335 A 5/1988 Budzich
4,799,420 A 1/1989 Budzich
5,137,254 A 8/1992 Aardema et al.
5,152,142 A 10/1992 Budzich
5,211,196 A 5/1993 Schwelm
5,287,794 A 2/1994 Andersson
5,297,381 A 3/1994 Eich et al.
5,313,873 A 5/1994 Gall et al.
5,350,152 A 9/1994 Hutchison et al.
5,366,202 A 11/1994 Lunzman (Continued)

FOREIGN PATENT DOCUMENTS

JP 02613041 B2 5/1997

OTHER PUBLICATIONS

U.S. Appl. No. 11/117,384, filed Apr. 29, 2005.
U.S. Appl. No. 11/117,385, filed Apr. 29, 2005.

*Primary Examiner*—Thomas E. Lazo
(74) *Attorney, Agent, or Firm*—Finnegan, Henderson, Farabow, Garrett & Dunner

(57) ABSTRACT

A hydraulic system for a work machine is disclosed. The hydraulic system has a source of pressurized fluid and a fluid actuator with a first chamber and a second chamber. The hydraulic system also has a first valve configured to selectively fluidly communicate the source with the first chamber and a second valve configured to selectively fluidly communicate the source with the second chamber. The hydraulic system further has a proportional pressure compensating valve configured to control a pressure of a fluid directed between the source and the first and second valves.

31 Claims, 2 Drawing Sheets

U.S. PATENT DOCUMENTS 5,447,093 A 9/1995 Budzich
5,477,677 A 12/1995 Krnavek
5,537,818 A 7/1996 Hosseini et al.
5,553,452 A 9/1996 Snow et al.
5,568,759 A 10/1996 Aardema
5,678,470 A 10/1997 Koehler et al.
5,701,933 A 12/1997 Lunzman
5,813,226 A 9/1998 Krone
5,813,309 A 9/1998 Taka et al.
5,857,330 A 1/1999 Ishizaki et al.
5,868,059 A 2/1999 Smith
5,878,647 A 3/1999 Wilke et al.
5,890,362 A 4/1999 Wilke
5,947,140 A 9/1999 Aardema et al.
5,960,695 A * 10/1999 Aardema et al. ..... 91/454
6,009,708 A 1/2000 Miki et al.
6,026,730 A 2/2000 Yoshida et al.
6,082,106 A 7/2000 Hamamoto
6,216,456 B1 4/2001 Mitchell
6,367,365 B1 4/2002 Weickert et al.
6,397,655 B1 6/2002 Stephenson
6,408,622 B1 * 6/2002 Tsuruga et al. ..... 60/422
6,467,264 B1 10/2002 Stephenson et al.
6,502,393 B1 1/2003 Stephenson et al.
6,502,500 B2 1/2003 Yoshino
6,516,614 B1 2/2003 Knoll
6,598,391 B2 7/2003 Lunzman et al.
6,619,183 B2 9/2003 Yoshino
6,655,136 B2 * 12/2003 Holt et al. ..... 60/414
6,662,705 B2 12/2003 Huang et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
2003/0121256 A1 7/2003 Mather
2003/0121409 A1 7/2003 Lunzman et al.
2003/0125840 A1 7/2003 Lunzman et al.
2003/0196545 A1 10/2003 Jensen et al.
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.

* cited by examiner

HYDRAULIC SYSTEM HAVING A PRESSURE COMPENSATOR

TECHNICAL FIELD

The present disclosure relates generally to a hydraulic system, and more particularly, to a hydraulic system having a pressure compensator.

BACKGROUND

Work machines such as, for example, dozers, loaders, excavators, motor graders, and other types of heavy machinery use one or more hydraulic actuators to accomplish a variety of tasks. These actuators are fluidly connected to a pump on the work machine that provides pressurized fluid to chambers within the actuators. An electro-hydraulic valve arrangement is typically fluidly connected between the pump and the actuators to control a flow rate and direction of pressurized fluid to and from the chambers of the actuators.

Work machine hydraulic circuits that fluidly connect multiple actuators to a common pump may experience undesirable pressure fluctuations within the circuits during operation of the actuators. In particular, the pressure of a fluid supplied to one actuator may undesirably fluctuate in response to operation of a different actuator fluidly connected to the same hydraulic circuit. These pressure fluctuations may cause inconsistent and/or unexpected actuator movements. In addition, the pressure fluctuations may be severe enough and/or occur often enough to cause malfunction or premature failure of hydraulic circuit components.

One method of reducing these pressure fluctuations within the fluid supplied to a hydraulic actuator is described in U.S. Pat. No. 5,878,647 (the '647 patent) issued to Wilke et al. on Mar. 9, 1999. The '647 patent describes a hydraulic circuit having two pairs of solenoid valves, a variable displacement pump, a reservoir tank, and a hydraulic actuator. One pair of the solenoid valves includes a head-end supply valve and a head-end return valve that connects a head end of the hydraulic actuator to either the variable displacement pump or the reservoir tank. The other pair of solenoid valves includes a rod-end supply valve and a rod-end return valve that connects a rod end of the hydraulic actuator to either the variable displacement pump or the reservoir tank. Each of these four solenoid valves is associated with a different pressure compensating check valve. Each pressure compensating check valve is connected between the associated solenoid valve and the actuator to control a pressure of the fluid between the associated valve and the actuator.

Although the multiple pressure compensating valves of the hydraulic circuit described in the '647 patent may reduce pressure fluctuations within the hydraulic circuit, they may increase the cost and complexity of the hydraulic circuit. In addition, the pressure compensating valves of the '647 patent may not control the pressures within the hydraulic circuit precise enough for optimal performance of the associated actuator.

The disclosed hydraulic cylinder is directed to overcoming one or more of the problems set forth above.

SUMMARY OF THE INVENTION

In one aspect, the present disclosure is directed to a hydraulic system. The hydraulic system includes a source of pressurized fluid and a fluid actuator with a first chamber and a second chamber. The hydraulic system also includes a first valve configured to selectively fluidly communicate the source with the first chamber and a second valve configured to selectively fluidly communicate the source with the second chamber. The hydraulic system further includes a proportional pressure compensating valve configured to control a pressure of a fluid directed between the source and the first and second valves.

In another aspect, the present disclosure is directed to a method of operating a hydraulic system. The method includes pressurizing a fluid, directing the pressurized fluid to a first chamber of an actuator via a first valve, and directing the pressurized fluid to a second chamber of the actuator via a second valve. The method also includes selectively operating at least one of the first and second valves to move the actuator. The method further includes moving a proportional pressure compensating valve element in response to pressures at an inlet and an outlet of one of the first and second valves to maintain a pressure differential across the one of the first and second valves within a predetermined range of a desired pressure differential.

DETAILED DESCRIPTION

Figure 1:
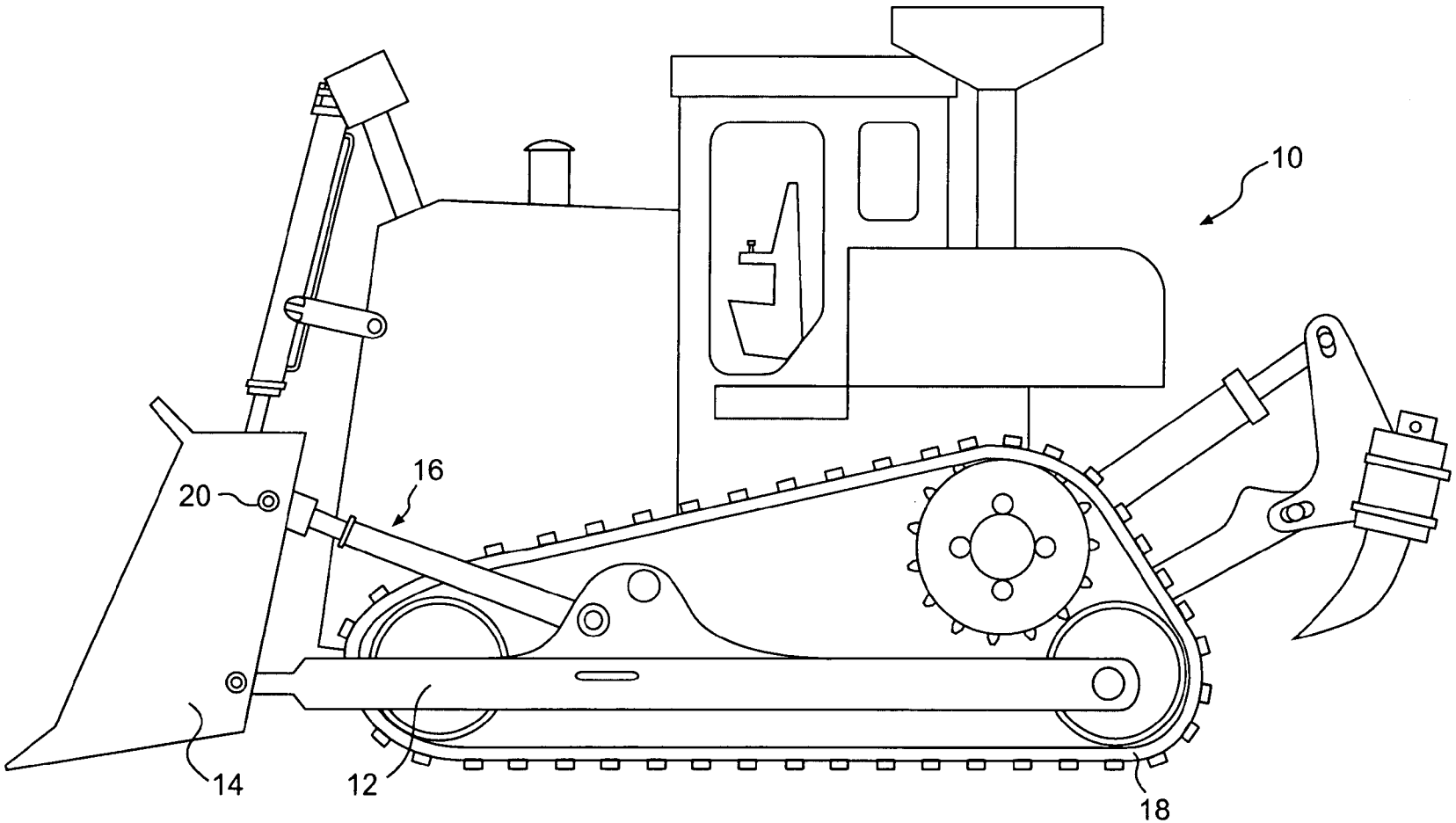
FIG. 1 is a side-view diagrammatic illustration of a work machine according to an exemplary disclosed embodiment.

FIG. 1 illustrates an exemplary work machine 10. Work machine 10 may be a fixed or mobile machine that performs some type of operation associated with an industry such as mining, construction, farming, or any other industry known in the art. For example, work machine 10 may be an earth moving machine such as a dozer, a loader, a backhoe, an excavator, a motor grader, a dump truck, or any other earth moving machine. Work machine 10 may also include a generator set, a pump, a marine vessel, or any other suitable operation-performing work machine. Work machine 10 may include a frame 12, at least one work implement 14, and a hydraulic cylinder 16 connecting work implement 14 to frame 12. It is contemplated that hydraulic cylinder 16 may be omitted, if desired, and a hydraulic motor included.

Frame 12 may include any structural unit that supports movement of work machine 10. Frame 12 may be, for example, a stationary base frame connecting a power source (not shown) to a traction device 18, a movable frame member of a linkage system, or any other frame known in the art.

Work implement 14 may include any device used in the performance of a task. For example, work implement 14 may include a blade, a bucket, a shovel, a ripper, a dump bed, a propelling device, or any other task-performing device known in the art. Work implement 14 may be connected to frame 12 via a direct pivot 20, via a linkage system with hydraulic cylinder 16 forming one member in the linkage system, or in any other appropriate manner. Work implement 14 may be configured to pivot, rotate, slide, swing, or move relative to frame 12 in any other manner known in the art.

Figure 2:
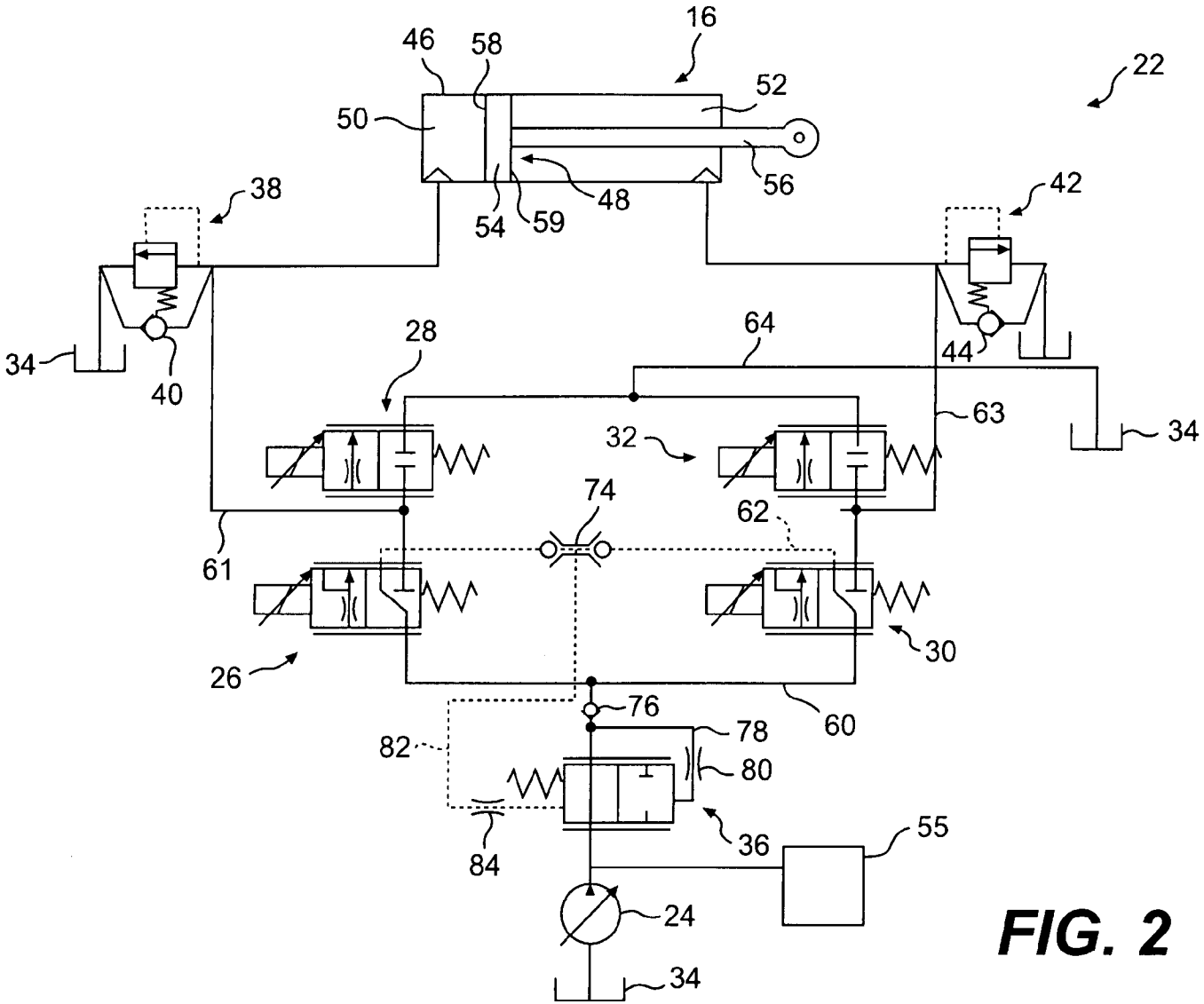
FIG. 2 is a schematic illustration of an exemplary disclosed hydraulic circuit.

As illustrated in FIG. 2, hydraulic cylinder 16 may be one of various components within a hydraulic system 22 that cooperate to move work implement 14. Hydraulic system 22 may include a source 24 of pressurized fluid, a head-end supply valve 26, a head-end drain valve 28, a rod-end supply valve 30, a rod-end drain valve 32, a tank 34, a proportional pressure compensating valve 36, a head-end pressure relief valve 38, a head-end makeup valve 40, a rod-end pressure relief valve 42, and a rod-end makeup valve 44. It is contemplated that hydraulic system 22 may include additional and/or different components such as, for example, a pressure sensor, a temperature sensor, a position sensor, a controller, an accumulator, and other components known in the art.

Hydraulic cylinder 16 may include a tube 46 and a piston assembly 48 disposed within tube 46. One of tube 46 and piston assembly 48 may be pivotally connected to frame 12, while the other of tube 46 and piston assembly 48 may be pivotally connected to work implement 14. It is contemplated that tube 46 and/or piston assembly 48 may alternately be fixedly connected to either frame 12 or work implement 14. Hydraulic cylinder 16 may include a first chamber 50 and a second chamber 52 separated by piston assembly 48. The first and second chambers 50, 52 may be selectively supplied with a fluid pressurized by source 24 and fluidly connected with tank 34 to cause piston assembly 48 to displace within tube 46, thereby changing the effective length of hydraulic cylinder 16. The expansion and retraction of hydraulic cylinder 16 may function to assist in moving work implement 14.

Piston assembly 48 may include a piston 54 axially aligned with and disposed within tube 46, and a piston rod 56 connectable to one of frame 12 and work implement 14 (referring to FIG. 1). Piston 54 may include a first hydraulic surface 58 and a second hydraulic surface 59 opposite first hydraulic surface 58. An imbalance of force caused by fluid pressure on first and second hydraulic surfaces 58, 59 may result in movement of piston assembly 48 within tube 46. For example, a force on first hydraulic surface 58 being greater than a force on second hydraulic surface 59 may cause piston assembly 48 to displace to increase the effective length of hydraulic cylinder 16. Similarly, when a force on second hydraulic surface 59 is greater than a force on first hydraulic surface 58, piston assembly 48 will retract within tube 46 to decrease the effective length of hydraulic cylinder 16. A sealing member (not shown), such as an o-ring, may be connected to piston 54 to restrict a flow of fluid between an internal wall of tube 46 and an outer cylindrical surface of piston 54.

Source 24 may be configured to produce a flow of pressurized fluid and may include a pump such as, for example, a variable displacement pump, a fixed displacement pump, or any other source of pressurized fluid known in the art. Source 24 may be drivably connected to a power source (not shown) of work machine 10 by, for example, a countershaft (not shown), a belt (not shown), an electrical circuit (not shown), or in any other suitable manner. Source 24 may be dedicated to supplying pressurized fluid only to hydraulic system 22, or alternately may supply pressurized fluid to additional hydraulic systems 55 within work machine 10.

Head-end supply valve 26 may be disposed between source 24 and first chamber 50 and configured to regulate a flow of pressurized fluid to first chamber 50. Specifically, head-end supply valve 26 may include a two-position spring biased valve mechanism that is solenoid actuated and configured to move between a first position at which fluid is allowed to flow into first chamber 50 and a second position at which fluid flow is blocked from first chamber 50. It is contemplated that head-end supply valve 26 may include additional or different mechanisms such as, for example, a proportional valve element or any other valve mechanisms known in the art. It is also contemplated that head-end supply valve 26 may alternately be hydraulically actuated, mechanically actuated, pneumatically actuated, or actuated in any other suitable manner. It is further contemplated that head-end supply valve 26 may be configured to allow fluid from first chamber 50 to flow through head-end supply valve 26 during a regeneration event when a pressure within first chamber 50 exceeds a pressure directed to head-end supply valve 26 from source 24.

Head-end drain valve 28 may be disposed between first chamber 50 and tank 34 and configured to regulate a flow of pressurized fluid from first chamber 50 to tank 34. Specifically, head-end drain valve 28 may include a two-position spring biased valve mechanism that is solenoid actuated and configured to move between a first position at which fluid is allowed to flow from first chamber 50 and a second position at which fluid is blocked from flowing from first chamber 50. It is contemplated that head-end drain valve 28 may include additional or different valve mechanisms such as, for example, a proportional valve element or any other valve mechanism known in the art. It is also contemplated that head-end drain valve 28 may alternately be hydraulically actuated, mechanically actuated, pneumatically actuated, or actuated in any other suitable manner.

Rod-end supply valve 30 may be disposed between source 24 and second chamber 52 and configured to regulate a flow of pressurized fluid to second chamber 52. Specifically, rod-end supply valve 30 may include a two-position spring biased valve mechanism that is solenoid actuated and configured to move between a first position at which fluid is allowed to flow into second chamber 52 and a second position at which fluid is blocked from second chamber 52. It is contemplated that rod-end supply valve 30 may include additional or different valve mechanisms such as, for example, a proportional valve element or any other valve mechanism known in the art. It is also contemplated that rod-end supply valve 30 may alternately be hydraulically actuated, mechanically actuated, pneumatically actuated, or actuated in any other suitable manner. It is further contemplated that rod-end supply valve 30 may be configured to allow fluid from second chamber 52 to flow through rod-end supply valve 30 during a regeneration event when a pressure within second chamber 52 exceeds a pressure directed to rod-end supply valve 30 from source 24.

Rod-end drain valve 32 may be disposed between second chamber 52 and tank 34 and configured to regulate a flow of pressurized fluid from second chamber 52 to tank 34. Specifically, rod-end drain valve 32 may include a two-position spring biased valve mechanism that is solenoid actuated and configured to move between a first position at which fluid is allowed to flow from second chamber 52 and a second position at which fluid is blocked from flowing from second chamber 52. It is contemplated that rod-end drain valve 32 may include additional or different valve mechanisms such as, for example, a proportional valve element or any other valve mechanism known in the art. It is also contemplated that rod-end drain valve 32 may alternately be hydraulically actuated, mechanically actuated, pneumatically actuated, or actuated in any other suitable manner.

Head-end and rod-end supply and drain valves 26–32 may be fluidly interconnected. In particular, head-end and rod-end supply valves 26, 30 may be connected in parallel to an upstream common fluid passageway 60 and connected to a downstream common fluid passageway 62. Head-end and rod-end drain valves 28, 32 may be connected in parallel to a common drain passageway 64. Head-end supply and return valves 26, 28 may be connected in parallel to an first chamber fluid passageway 61. Rod-end supply and return valves 30, 32 may be connected in parallel to a common second chamber fluid passageway 63.

Head-end pressure relief valve 38 may be fluidly connected to first chamber fluid passageway 61 between first chamber 50 and head-end supply and drain valves 26, 28. Head-end pressure relief valve 38 may have a valve element spring biased toward a valve opening position and movable to a valve closing position in response to a pressure within first chamber fluid passageway 61 being above a predetermined pressure. In this manner, head-end pressure relief valve 38 may be configured to reduce a pressure spike within hydraulic system 22 caused by external forces acting on work implement 14 and piston 54 by allowing fluid from first chamber 50 to drain to tank 34.

Head-end makeup valve 40 may be fluidly connected to first chamber fluid passageway 61 between first chamber 50 and head-end supply and drain valves 26, 28. Head-end makeup valve 40 may have a valve element configured to allow fluid from tank 34 into first chamber fluid passageway 61 in response to a fluid pressure within first chamber fluid passageway 61 being below a pressure of the fluid within tank 34. In this manner, head-end makeup valve 40 may be configured to reduce a drop in pressure within hydraulic system 22 caused by external forces acting on work implement 14 and piston 54 by allowing fluid from tank 34 to fill first chamber 50.

Rod-end pressure relief valve 42 may be fluidly connected to second chamber fluid passageway 63 between second chamber 52 and rod-end supply and drain valves 30, 32. Rod-end pressure relief valve 42 may have a valve element spring biased toward a valve opening position and movable to a valve closing position in response to a pressure within second chamber fluid passageway 63 being above a predetermined pressure. In this manner, rod-end pressure relief valve 42 may be configured to reduce a pressure spike within hydraulic system 22 caused by external forces acting on work implement 14 and piston 54 by allowing fluid from second chamber 52 to drain to tank 34.

Rod-end makeup valve 44 may be fluidly connected to second chamber fluid passageway 63 between second chamber 52 and rod-end supply and drain valves 30, 32. Rod-end makeup valve 44 may have a valve element configured to allow fluid from tank 34 into second chamber fluid passageway 63 in response to a fluid pressure within second chamber fluid passageway 63 being below a pressure of the fluid within tank 34. In this manner, rod-end makeup valve 44 may be configured to reduce a drop in pressure within hydraulic system 22 caused by external forces acting on work implement 14 and piston 54 by allowing fluid from tank 34 to fill second chamber 52.

Hydraulic system 22 may include additional components to control fluid pressures and/or flows within hydraulic system 22. Specifically, hydraulic system 22 may include a shuttle valve 74 that is disposed within downstream common fluid passageway 62. Shuttle valve 74 may be configured to fluidly connect the one of head-end and rod-end supply valves 26, 30 having a lower fluid pressure to proportional pressure compensating valve 36 in response to a higher fluid pressure from either head-end or rod-end supply valves 26, 30. In this manner, shuttle valve 74 may resolve pressure signals from head-end and rod-end supply valves 26, 30 to allow the lower outlet pressure of the two valves to affect movement of proportional pressure compensating valve 36. Because shuttle valve allows the lower pressure to affect proportional pressure compensating valve 36 in response to the higher pressure, proportional pressure compensating valve may function correctly even during regeneration events. Hydraulic system 22 may also include a check valve 76 disposed between proportional pressure compensating valve 36 and upstream fluid passageway 60. It is contemplated that hydraulic system 22 may include additional and/or different components to control fluid pressures and/or flows within hydraulic system 22.

Tank 34 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 34. It is also contemplated that hydraulic system 22 may be connected to multiple separate fluid tanks.

Proportional pressure compensating valve 36 may be a hydro-mechanically actuated proportional control valve disposed between upstream common fluid passageway 60 and source 24, and may be configured to control a pressure of the fluid supplied to upstream common fluid passageway 60. Specifically, proportional pressure compensating valve 36 may include a valve element that is spring biased and hydraulically biased toward a flow passing position and movable by hydraulic pressure toward a flow blocking position. In one embodiment, proportional pressure compensating valve 36 may be movable toward the flow blocking position by a fluid directed via a fluid passageway 78 from a point between proportional pressure compensating valve 36 and check valve 76. A restrictive orifice 80 may be disposed within fluid passageway 78 to minimize pressure and/or flow oscillations within fluid passageway 78. Proportional pressure compensating valve 36 may be movable toward the flow passing position by a fluid directed via a fluid passageway 82 from shuttle valve 74. A restrictive orifice 84 may be disposed within fluid passageway 82 to minimize pressure and/or flow oscillations within fluid passageway 82. It is contemplated that the valve element of proportional pressure compensating valve 36 may alternately be spring biased toward a flow blocking position, that the fluid from passageway 82 may alternately bias the valve element of proportional pressure compensating valve 36 toward the flow passing position, and/or that the fluid from passageway 78 may alternately move the valve element of proportional pressure compensating valve 36 toward the flow blocking position. It is also contemplated that proportional pressure compensating valve 36 may alternately be located downstream of head-end and rod-end supply valves 26, 30 or in any other suitable location. It is also contemplated that restrictive orifices 80 and 84 may be omitted, if desired.

INDUSTRIAL APPLICABILITY

The disclosed hydraulic system may be applicable to any work machine that includes a fluid actuator where balancing of pressures and/or flows of fluid supplied to the actuator is desired. The disclosed hydraulic system may provide high response pressure regulation that protects the components of the hydraulic system and provides consistent actuator performance in a low cost simple configuration. The operation of hydraulic system 22 will now be explained.

Hydraulic cylinder 16 may be movable by fluid pressure in response to an operator input. Fluid may be pressurized by source 24 and directed to head-end and rod-end supply valves 26 and 30. In response to an operator input to either extend or retract piston assembly 48 relative to tube 46, one of head-end and rod-end supply valves 26 and 30 may move to the open position to direct the pressurized fluid to the appropriate one of first and second chambers 50, 52. Substantially simultaneously, one of head-end and rod-end drain valves 28, 32 may move to the open position to direct fluid from the appropriate one of the first and second chambers 50, 52 to tank 34 to create a pressure differential across piston 54 that causes piston assembly 48 to move. For example, if an extension of hydraulic cylinder 16 is requested, head-end supply valve 26 may move to the open position to direct pressurized fluid from source 24 to first chamber 50. Substantially simultaneous to the directing of pressurized fluid to first chamber 50, rod-end drain valve 32 may move to the open position to allow fluid from second chamber 52 to drain to tank 34. If a retraction of hydraulic cylinder 16 is requested, rod-end supply valve 30 may move to the open position to direct pressurized fluid from source 24 to second chamber 52. Substantially simultaneous to the directing of pressurized fluid to second chamber 52, head-end drain valve 28 may move to the open position to allow fluid from first chamber 50 to drain to tank 34.

Because multiple actuators may be fluidly connected to source 24, the operation of one of the actuators may affect the pressure and/or flow of fluid directed to hydraulic cylinder 16. If left unregulated, these affects could result in inconsistent and/or unexpected motion of hydraulic cylinder 16 and work implement 14, and could possibly result in shortened component life of hydraulic system 22. Proportional pressure compensating valve 36 may account for these affects by proportionally moving the valve element of proportional pressure compensating valve 36 between the flow passing and flow blocking positions in response to fluid pressures within hydraulic system 22 to provide a substantially constant predetermined pressure drop across all supply valves of hydraulic system 22.

As one of head-end and rod-end supply valves 26, 30 are moved to the flow passing position, pressure within the flow passing valve may be lower than the pressure of the fluid directed to the flow blocking valve. As a result, shuttle valve 74 may be biased by the higher pressure toward the flow passing valve, thereby communicating the lower pressure from the flow passing valve to proportional pressure compensating valve 36. This lower pressure may then act together with the force of the proportional pressure compensating valve spring against the pressure from fluid passageway 78. The resultant force may then either move the valve element of proportional pressure compensating valve 36 toward the flow blocking or flow passing positions. As the pressure from source 24 drops, proportional pressure compensating valve 36 may move toward the flow passing position and thereby maintain the pressure within upstream common fluid passageway 60. Similarly, as the pressure from source 24 increases, proportional pressure compensating valve 36 may move toward the flow blocking position to thereby maintain the pressure within upstream common fluid passageway 60. In this manner, proportional pressure compensating valve 36 may regulate the fluid pressure within hydraulic system 22.

Proportional pressure compensating valve 36 may also be configured to reduce pressure and/or flow fluctuations within hydraulic system 22 caused by the occurrence of regeneration processes within hydraulic system 22. In particular, during movement of work implement 14, there may be instances when an external force on work implement 14 generates a pressure within one of first and second chambers 50, 52 that is greater than the pressure of the fluid supplied to head-end or rod-end supply valves 26, 30 by source 24. During theses instances, this high pressure fluid may be regenerated to conserve energy. Specifically, this high pressure fluid may be directed from the appropriate one of first and second chambers 50, 52 to upstream common fluid passageway 60. Proportional pressure compensating valve 36 may accommodate this supply of high pressure fluid by moving the valve element of proportional pressure compensating valve 36 toward the flow blocking position. In this manner, proportional pressure compensating valve 36 may provide substantially constant pressure even during regeneration processes.

Because proportional pressure compensating valve 36 is hydro-mechanically actuated, pressure fluctuations within hydraulic system 22 may be quickly accommodated before they can significantly influence motion of hydraulic cylinder 16 or life of components within hydraulic system 22. In particular, the response time of proportional pressure compensating valve 36 may be about 200 hz or higher, which is much greater than typical solenoid actuated valves that respond at about 5–15 hz. In addition, because proportional pressure compensating valve 36 may be hydro-mechanically actuated rather than electronically controlled, the cost of hydraulic system 22 may be minimized.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a source of pressurized fluid;

a fluid actuator having a first chamber and a second chamber;

a first valve configured to selectively fluidly communicate the source with the first chamber;

a second valve configured to selectively fluidly communicate the source with the second chamber; and a proportional pressure compensating valve configured to control a pressure of a fluid directed between the source and the first and second valves dependent on a load acting on the fluid actuator.

2. The hydraulic system of claim 1, further including:

a tank;

a third valve configured to selectively fluidly communicate the tank with the first chamber; and a fourth valve configured to selectively fluidly communicate the tank with the second chamber.

3. The hydraulic system of claim 1, further including a first fluid passageway disposed between the source and the first and second valves, wherein the first and second valves are connected to the first fluid passageway in parallel and the proportional pressure compensating valve is disposed between the first fluid passageway and the source.

4. The hydraulic system of claim 3, further including a second fluid passageway, wherein the proportional pressure compensating valve includes a valve element movable between a flow passing position and a flow blocking position, and the second fluid passageway is configured to direct fluid from between the proportional pressure compensating valve and the first fluid passageway to the proportional pressure compensating valve to bias the valve element toward one of the flow passing position and the flow blocking position.

5. The hydraulic system of claim 4, further including:

a third fluid passageway disposed downstream of the first and second valves, the first and second valves being in fluid communication with the third fluid passageway; and a shuttle valve disposed within the third fluid passageway between the first and second valves and movable between a first position where pressurized fluid from the first valve is passed through the shuttle valve, to a second position where pressurized fluid from the second valve is passed through the shuttle valve.

6. The hydraulic system of claim 5, further including a fourth fluid passageway configured to direct pressurized fluid from one of the first and second valves via the shuttle valve to the proportional pressure compensating valve to bias the proportional pressure compensating valve element toward the other of the flow passing and flow blocking position.

7. The hydraulic system of claim 6, wherein the proportional pressure compensating valve includes a spring configured to bias the valve element toward one of the flow passing and flow blocking positions.

8. The hydraulic system of claim 5, wherein the shuttle valve is movable in response to a fluid pressure.

9. The hydraulic system of claim 1, further including a check valve disposed between the proportional pressure compensating valve and the first fluid passageway.

10. The hydraulic system of claim 1, wherein each of the first, second, third, and fourth valves are solenoid actuated proportional control valves.

11. The hydraulic system of claim 1, further including at least one pressure relief valve fluidly connected to one of the first chamber and the second chamber, the at least one pressure relief valve being configured to communicate the one of the first and second chambers with the tank in response to a fluid pressure within the one of the first and second chambers exceeding a predetermined pressure.

12. The hydraulic system of claim 1, further including at least one makeup valve fluidly connected to one of the first and second chambers, the at least one makeup valve being configured to communicate the one of the first and second chambers with the tank in response to a fluid pressure within the one of the first and second chambers dropping below a predetermined pressure.

13. The hydraulic system of claim 1, wherein the hydraulic system is a first hydraulic system and the source of pressurized fluid is configured to pressurize fluid supplied to the first hydraulic system and to a second hydraulic system.

14. A method of operating a hydraulic system, comprising:

pressurizing a fluid;

directing the pressurized fluid to a first chamber of an actuator via a first valve;

directing the pressurized fluid to a second chamber of the actuator via a second valve;

selectively operating at least one of the first and second valves to move the actuator; and moving a proportional pressure compensating valve element in response to pressures at an inlet and an outlet of one of the first and second valves to maintain a pressure differential across the one of the first and second valves within a predetermined range of a desired pressure differential and dependent on a load associated with the actuator.

15. The method of claim 14, further including:

directing the pressurized fluid from the first chamber to a tank via a third valve;

directing the pressurized fluid from the second chamber to the tank via a fourth valve; and selectively operating one of the third and fourth valves when one of the first and second valves is operated to move the actuator.

16. The method of claim 14, wherein directing pressurized fluid to the first and second chambers includes directing the pressurized fluid through a first fluid passageway disposed upstream of the first and second valves, the first and second valves are connected to the first fluid passageway in parallel, and the proportional pressure compensating valve element is disposed between the first fluid passageway and a source of the pressurized fluid.

17. The method of claim 16, further including directing pressurized fluid from the actuator to the first fluid passageway via the first and second valves when a pressure within one of the first and second chambers of the actuator exceeds a pressure within the first fluid passageway.

18. The method of claim 16, wherein moving the proportional pressure compensating valve element includes directing pressurized fluid from between the proportional pressure compensating valve element and the first fluid passageway to the proportional pressure compensating valve element to bias the proportional pressure compensating valve element toward one of a flow passing position and a flow blocking position.

19. The method of claim 18, further including selectively communicating pressurized fluid from one of the first and second valves to the proportional pressure compensating valve element to bias the proportional pressure compensating valve element toward the other of the flow passing position and the flow blocking position.

20. The method of claim 19, wherein selectively communicating pressurized fluid from one of the first and second valves to the proportional pressure compensating valve element includes directing the pressurized fluid from a shuttle valve member disposed within a common fluid passageway downstream of the first and second valves.

21. The method of claim 20, further including mechanically biasing the proportional pressure compensating valve element toward one of the flow passing and the flow blocking positions.

22. The method of claim 15, wherein each of the first, second, third, and fourth valves are solenoid actuated proportional control valves.

23. A machine, comprising:

a work implement; and a hydraulic system, including:

a source of pressurized fluid;

a tank;

a fluid actuator having a first chamber and a second chamber, the fluid actuator being configured to move the work implement;

a first valve configured to selectively fluidly communicate the source with the first chamber;

a second valve configured to selectively fluidly communicate the source with the second chamber;

a proportional pressure compensating valve configured to control a pressure of a fluid directed between the source and the first and second valves;

a third valve configured to selectively fluidly communicate the first chamber with the tank;

a fourth valve configured to selectively fluidly communicate the second chamber with the tank; and a shuttle valve disposed between the first and second valves, wherein the shuffle valve is configured to selectively fluidly communicate pressurized fluid associated with the one of the first and second valves having a lower pressure than the pressurized fluid associated with the other one of the first and second valves toward the proportional pressure compensating valve.

24. The machine of claim 23, further including a first fluid passageway disposed upstream of the first and second valves, wherein the first and second valves are connected to the first fluid passageway in parallel and the proportional pressure compensating valve is disposed between the first fluid passageway and the source.

25. The machine of claim 24, further including a second fluid passageway, wherein the proportional pressure compensating valve includes a valve element movable between a flow passing position and a flow blocking position, and the second fluid passageway is configured to direct fluid from between the proportional pressure compensating valve and the first fluid passageway to the proportional pressure compensating valve to bias the valve element toward one of the flow passing position and the flow blocking position.

26. The machine of claim 25, further including:

a third fluid passageway disposed downstream of the first and second valves, the first and second valves being in fluid communication with the third fluid passageway wherein the shuttle valve is disposed within the third fluid passageway.

27. The machine of claim 26, further including a fourth fluid passageway configured to direct fluid from the shuttle valve to the proportional pressure compensating valve to bias the valve element toward the other of the flow passing position and the flow blocking position.

28. The machine of claim 23, wherein the proportional pressure compensating valve includes a spring configured to bias the valve element toward one of the flow passing and flow blocking positions.

29. The machine of claim 23, wherein the shuttle valve is disposed downstream of the first and second valves.

30. The machine of claim 23, further including a check valve disposed between the proportional pressure compensating valve and the first fluid passageway.

31. The machine of claim 23, wherein each of the first, second, third, and fourth valves are solenoid actuated proportional control valves.

* * * * *

UNITED STATES PATENT AND TRADEMARK OFFICE

CERTIFICATE OF CORRECTION

PATENT NO. : 7,204,084 B2
APPLICATION NO. : 10/975413
DATED : April 17, 2007
INVENTOR(S) : Ma et al.

It is certified that error appears in the above-identified patent and that said Letters Patent is hereby corrected as shown below:

In Column 10, Line 62, in Claim 23, delete “shuffle” and insert --shuttle--

Signed and Sealed this

Sixth Day of May, 2008

JON W. DUDAS
*Director of the United States Patent and Trademark Office*